US010907368B2

(12) United States Patent
Fujiwara et al.

(10) Patent No.: US 10,907,368 B2
(45) Date of Patent: Feb. 2, 2021

(54) REINFORCEMENT STRUCTURE, EQUIPMENT FRAME, AND BOOTH

(71) Applicant: TRINITY INDUSTRIAL CORPORATION, Toyota (JP)

(72) Inventors: Shigeki Fujiwara, Toyota (JP); Takaaki Tamura, Toyota (JP); Masayuki Miyake, Yokkaichi (JP)

(73) Assignee: TRINITY INDUSTRIAL CORPORATION, Toyota (JP)

( * ) Notice: Subject to any disclaimer, the term of this patent is extended or adjusted under 35 U.S.C. 154(b) by 0 days.

(21) Appl. No.: 16/619,028

(22) PCT Filed: Mar. 15, 2018

(86) PCT No.: PCT/JP2018/010126
§ 371 (c)(1),
(2) Date: Dec. 3, 2019

(87) PCT Pub. No.: WO2019/008834
PCT Pub. Date: Jan. 10, 2019

(65) Prior Publication Data

US 2020/0087938 A1 Mar. 19, 2020

(30) Foreign Application Priority Data

Jul. 3, 2017 (JP) ..... 2017-130506

(51) Int. Cl.
*E04G 23/02* (2006.01)
*E04B 1/24* (2006.01)
(Continued)

(52) U.S. Cl.
CPC ..... *E04G 23/0218* (2013.01); *E04B 1/24* (2013.01); *E04B 1/2403* (2013.01); *E04C 3/40* (2013.01);
(Continued)

(58) Field of Classification Search
CPC ..... E04G 23/0218; E04B 1/24; E04B 1/58; E04B 2001/246; E04B 2001/2463;
(Continued)

(56) References Cited

U.S. PATENT DOCUMENTS 2,994,944 A * 8/1961 Prudhon ..... E04B 7/022 29/897.31
3,039,152 A * 6/1962 Hillesheim ..... E04C 3/42 52/93.1

(Continued)

FOREIGN PATENT DOCUMENTS

JP S60-12916 B2 4/1985
JP H09-242183 A 9/1997

(Continued)

OTHER PUBLICATIONS

Jun. 5, 2018 Written Opinion issued in International Patent Application No. PCT/JP2018/010126.

(Continued)

*Primary Examiner* — Jessie T Fonseca
(74) *Attorney, Agent, or Firm* — Oliff PLC

(57) ABSTRACT

A reinforcement structure includes compound trusses placed horizontally symmetrically, and each compound truss is constituted by a first truss and a second truss. Each first truss has: a vertical side; a first inclined side extending obliquely downward from an upper end of the vertical side; and a second inclined side connecting between the vertical side and a lower end of the first inclined side. Each second truss shares the first inclined side with the first truss and has: a horizontal side extending horizontally from the upper end of the vertical side; and a second inclined side connecting between a tip end of the horizontal side and the lower end of the first inclined side. Each compound truss is coupled to the construction in a state where the vertical side is along an
(Continued)

inner side surface of the construction and the horizontal side is along a ceiling surface of the construction.

19 Claims, 12 Drawing Sheets

(51) Int. Cl.
*E04H 9/02* (2006.01)
*E04C 3/40* (2006.01)
*E04B 1/58* (2006.01)

(52) U.S. Cl.
CPC ..... *E04H 9/021* (2013.01); *E04B 1/58* (2013.01); *E04H 9/024* (2013.01)

(58) Field of Classification Search
CPC ..... E04B 2001/2415; E04B 1/2403; E04B 2001/2487; E04B 2001/2418; E04B 2001/2496; E04B 7/022; E04B 7/024; E04B 1/348; E04B 1/34815; E04H 5/02; E04H 9/02; E04H 9/021; E04H 9/024; E04C 3/40
See application file for complete search history.

(56) References Cited

U.S. PATENT DOCUMENTS 3,156,018 A * 11/1964 Slayter ..... E04B 1/34815 52/73
3,172,507 A * 3/1965 Blyveis ..... E04B 7/024 52/698
3,263,381 A * 8/1966 Dickinson ..... E04C 3/42 52/93.1
3,343,321 A * 9/1967 Axelsson ..... E04B 1/34315 52/296
3,526,068 A * 9/1970 Buxton ..... E04C 3/40 52/86
3,530,623 A * 9/1970 Burton ..... E04C 3/40 52/86
4,030,256 A * 6/1977 Ollman ..... E04B 7/022 52/93.1
4,201,021 A * 5/1980 Aldag ..... E04B 1/24 52/639
4,245,828 A * 1/1981 Aldag ..... E04C 3/40 269/228
4,887,406 A * 12/1989 Saia ..... E04B 7/024 52/694
6,006,485 A * 12/1999 Hobbs ..... E04B 1/24 52/489.1
6,212,850 B1 * 4/2001 Branson ..... A01K 1/00 119/437
6,293,057 B1 * 9/2001 Amos Hays ..... E04B 1/24 52/639
6,318,043 B1 * 11/2001 Johnson ..... E04H 1/1205 52/639
8,186,120 B2 * 5/2012 Beck ..... H02S 20/23 52/644
2001/0015047 A1 * 8/2001 Branson ..... A01K 1/00 52/745.01
2014/0053494 A1 2/2014 Russell

FOREIGN PATENT DOCUMENTS

JP 3242775 B2 12/2001
JP 2002-180536 A 6/2002
JP 2005-048393 A 2/2005
JP 2007-284917 A 11/2007
JP 4445007 B2 4/2010

OTHER PUBLICATIONS

Jun. 5, 2018 Search Report issued in International Patent Application No. PCT/JP2018/010126.

* cited by examiner

REINFORCEMENT STRUCTURE, EQUIPMENT FRAME, AND BOOTH

TECHNICAL FIELD

The present invention relates to a reinforcement structure that reinforces a construction from inside and relates to an equipment frame and a booth that are reinforced by the reinforcement structure.

BACKGROUND ART

In recent years, quake resistance of constructions has been required to be increased, and, for example, in the case of constructions such as residences, measures are taken such as providing many braces inside partition walls partitioning internal spaces of the constructions (see Patent Literature 1, for example).

RELATED ART DOCUMENTS

Patent Documents

Patent document 1: Japanese Unexamined Patent Application Publication No. 2002-180536 A (paragraph [0017], FIG. 1)

DISCLOSURE OF THE INVENTION

Problems to be Solved by the Invention

However, inside constructions in factories such as equipment frames and booths, there are provided passages, line equipment, and the like; therefore, it is impossible to place a brace that crosses obliquely between inner side surfaces of the constructions. In contrast, a structure can be considered in which a pair of braces are placed between inner side surfaces of a construction so as to configure two sides of an isosceles triangle so that passages and line equipment go through inner side of the braces; however the braces act as obstacles to extremely limit the arrangement of the passages and line equipment, whereby it is difficult to provide braces. Therefore, it is desired to develop a technology that can reinforce a construction without causing an obstacle in the construction like a brace.

Means of Solving the Problems

A reinforcement structure according to one aspect of the present invention reinforces a construction from inside, and the reinforcement structure includes: (i) a first truss including: a vertical side extending vertically; a first inclined side extending obliquely downward from an upper end of the vertical side; and a second inclined side connecting a lower end of the vertical side and a lower end of the first inclined side; (ii) a second truss sharing the first inclined side with the first truss and including: a horizontal side extending horizontally from the upper end of the vertical side of the first truss; and a second inclined side connecting between a tip end of the horizontal side and the lower end of the first inclined side; (iii) a pair of compound trusses each of which is constituted by the first truss and the second truss and which are horizontally symmetrically placed, wherein the pair of compound trusses are coupled to the construction in a state where, in each of the compound trusses, the vertical side is along an inner side surface of the construction, and the horizontal side is along a ceiling surface of the construction; and (iv) a pair of bent sides each of which is provided in each of the pair of compound trusses and is constituted by the second inclined side of the first truss and the second inclined side of the second truss, wherein each of the bent sides has a shape of being bent toward a side away from a symmetry center of the pair of compound trusses.

MODE FOR CARRYING OUT THE INVENTION

First Embodiment

Figure 1:
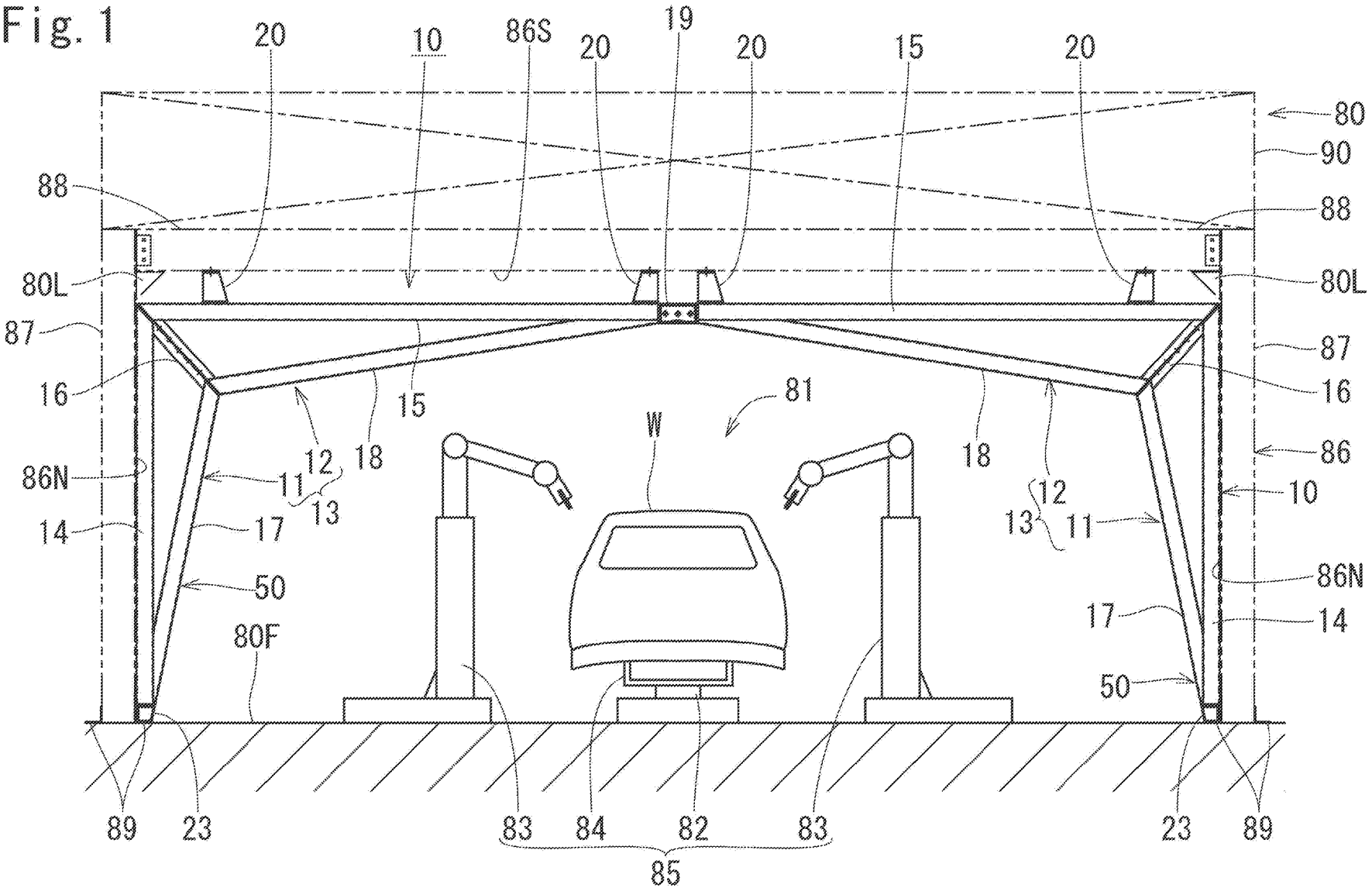
FIG. 1 is a front view of a reinforcement structure and a construction of a first embodiment of the invention.

Hereinafter, a first embodiment of the invention will be described with reference to FIGS. 1 to 7. In FIG. 1, the reference sign 80 represents a booth covering a painting line 81. The painting line 81 includes a conveying rail 82 extending in a direction perpendicular to the paper surface of FIG. 1, and a plurality of painting robots 83 are placed on the both sides of the conveying rail 82. A booth 80 extends in a direction perpendicular to the paper surface of FIG. 1 similarly to the painting line 81 and covers line equipment 85 such as the conveying rail 82 and the painting robots 83.

Specifically, the booth 80 includes a plurality of equipment frames 86 in a longitudinal direction (direction perpendicular to the paper surface of FIG. 1) at intervals (FIG. 1 shows only one equipment frame 86). Each equipment frame 86 is constituted by, for example, a pair of columns 87 and 87 and a beam 88 bridged between upper ends of columns 87 and 87, and has a gate-shaped structure in which the width is greater than the height. Further, between the adjacent equipment frames 86 and 86, there are attached side panels (not shown) that cover the line equipment 85 from both sides, and on the plurality of equipment frames 86, there is placed air conditioning duct 90 that also serves as a ceiling part. Then, inside the booth 80, a work W (for example, a body of a vehicle) is conveyed along the conveying rail 82 while being mounted on a carriage 84 and is painted by painting robots 83.

Not shown in the drawing, but inside the side panels there are provided, for example: a beam connecting the upper end parts of the equipment frames 86 and 86; and braces obliquely extended between the equipment frames 86 and 86.

Figure 2:
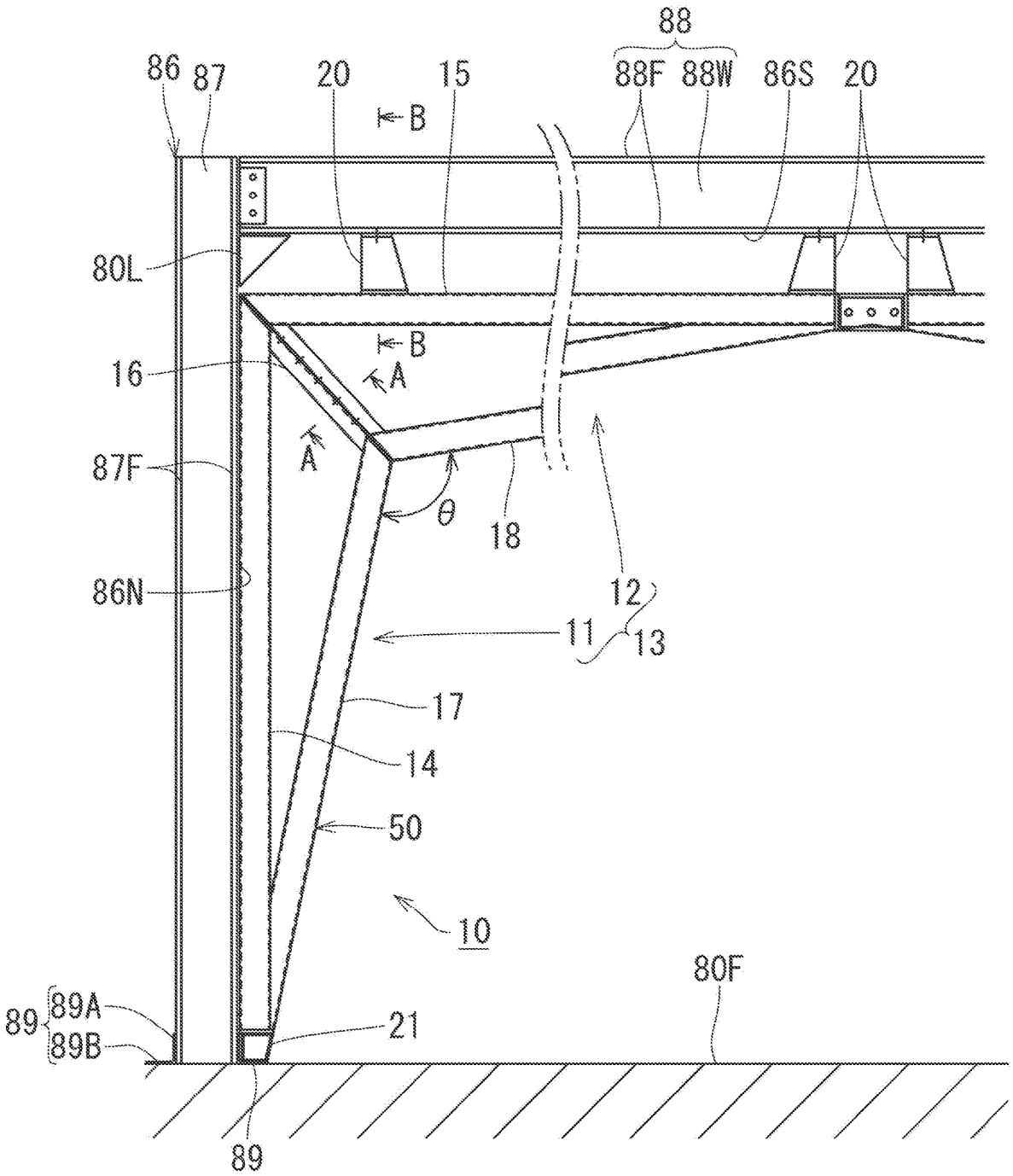
FIG. 2 is a front view of a compound truss.

As shown in FIG. 2, the columns 87 and 87 and the beam 88 of the equipment frame 86 are all configured of, for example, H-section steels, and the H-section steel of each column 87 has a pair of flanges 87F and 87F in a direction in which the columns 87 and 87 oppose each other. The H-section steel of the beam 88 has a pair of flanges 88F and 88F in vertical arrangement.

To an inside corner part between the column 87 and the beam 88 there is a welded triangular rib 80L. At a lower end part of the column 87, perpendicular walls 89A of angle members 89 are each stacked on and welded to an outer surface of both of the flanges 87F and 87F, and horizontal walls 89B of the angle members 89 are laid on a floor surface. In addition, an anchor bolt (not shown) is inserted through a through hole formed in the horizontal wall 89B as required so as to fix the horizontal wall 89B to a floor surface 80F.

The above booth 80 and a single body of the equipment frame 86, which is a part of the booth 80, correspond to the "construction". Further, in the present embodiment, a reinforcement structure 10 is provided inside each equipment frame 86. Note that opposing surfaces of the respective columns 87 and 87 of the equipment frame 86 correspond to a "pair of inner side surfaces of the construction", and a lower surface of the beam 88 corresponds to a "ceiling surface of the construction"; therefore, in the following description, the opposing surfaces of the columns 87 and 87 are each referred to as an "inner side surface 86N of the equipment frame 86", and the lower surface of the beam 88 is referred to as a "ceiling surface 86S of the equipment frame 86".

FIG. 1 is a whole view of the reinforcement structure 10. The reinforcement structure 10 includes a pair of horizontally symmetrically placed compound trusses 13 and 13, and each compound truss 13 is configured of a first truss 11 and a second truss 12. The first truss 11 has: a vertical side 14 extending vertically; a first inclined side 16 extending obliquely downward (specifically, obliquely 45 degrees downward) from an upper end of the vertical side 14; and a second inclined side 17 connecting between a lower end of the vertical side 14 and a lower end of the first inclined side 16. On the other hand, the second truss 12 has: a horizontal side 15 extending horizontally from the upper end of the vertical side 14; and a second inclined side 18 connecting between the tip end of the horizontal side 15 and the lower end of the first inclined side 16. The first inclined side 16 is shared by the first truss 11 and the second truss 12. Due to this configuration, in each compound truss 13, a bent side 50 is constituted by the second inclined side 17 of the first truss 11 and the second inclined side 18 of the second truss 12, and the bent side 50 is shaped to be bent toward a side away from a symmetry center of the pair of compound trusses 13 and 13.

Figure 3:
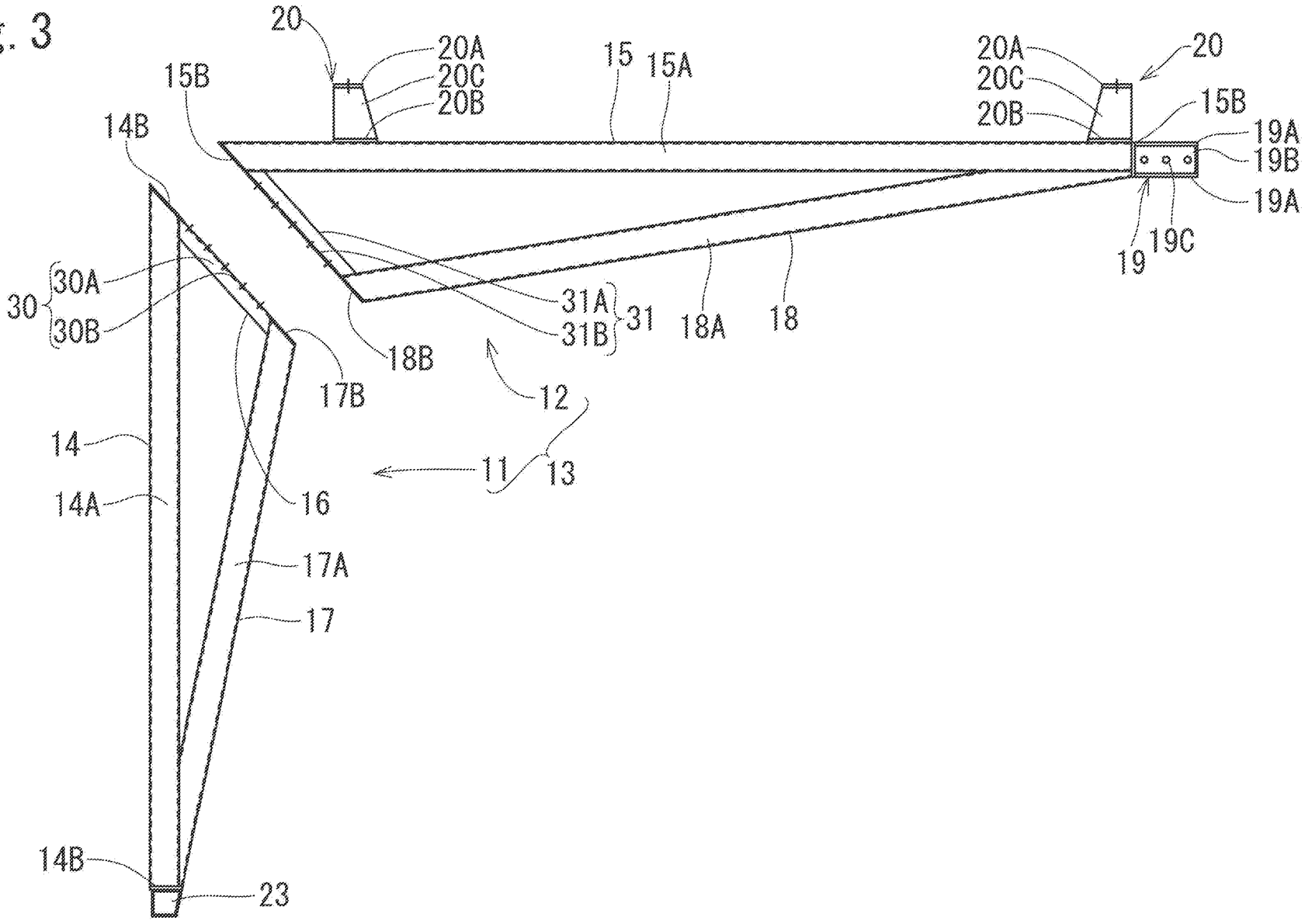
FIG. 3 is a front view of the compound truss that is disassembled into a first truss and a second truss.

As shown in FIG. 3, the compound truss 13 can be disassembled into the first truss 11 and the second truss 12. The first truss 11 includes: a vertical member 14A extending along the vertical side 14 and made of a square steel stock; a second inclined member 17A extending along the second inclined side 17 and made of a square steel stock; and a first inclined member 30 extending along the first inclined side 16 and made of a channel member.

The vertical member 14A is obliquely cut at an upper end part at an angle corresponding to an inclination angle of the first inclined side 16 (for example, 45 degrees), and cover plates 14B and 14B are respectively welded to upper and lower opening surfaces.

Figure 7:
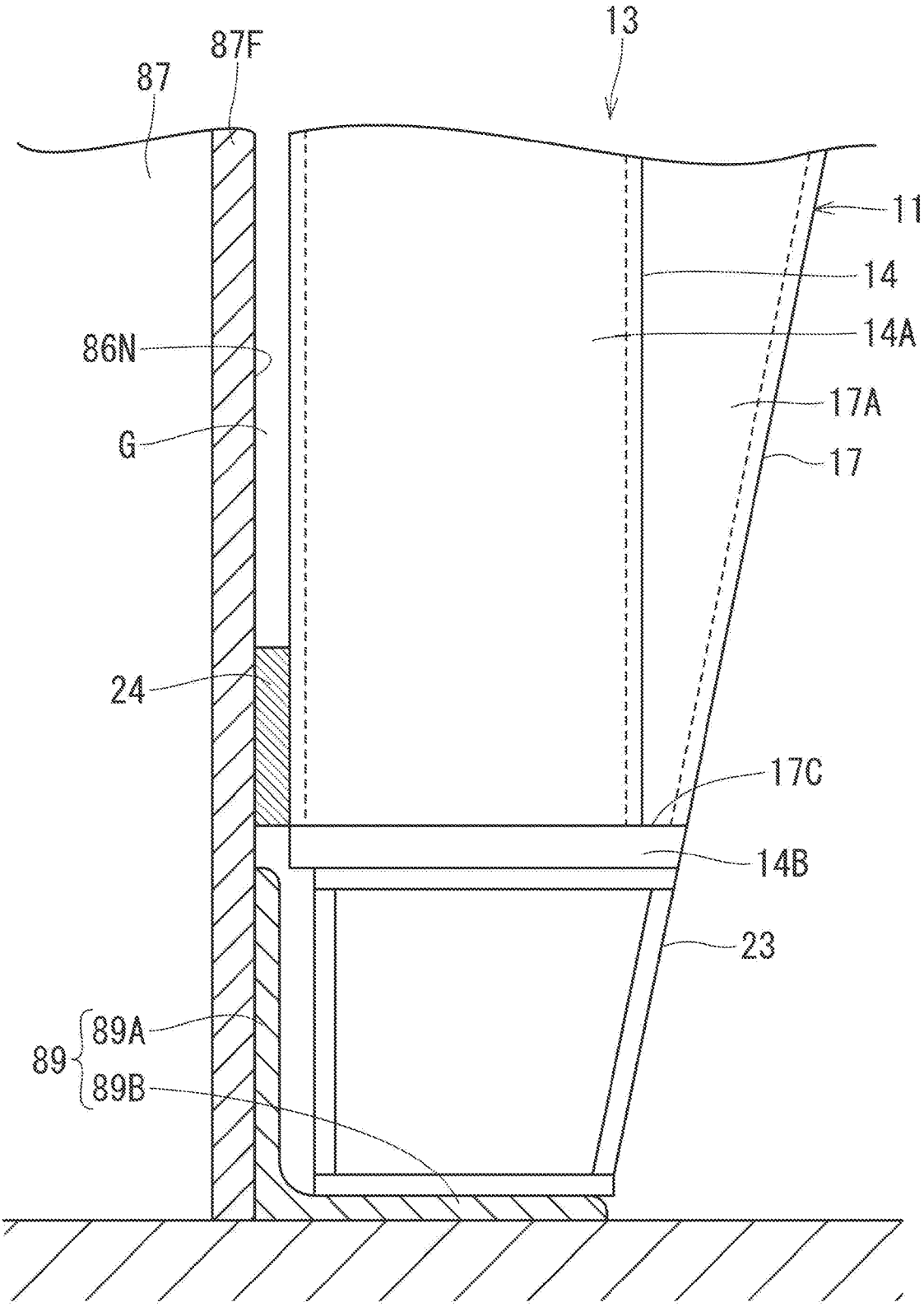
FIG. 7 is a side view of a lower end part of the compound truss and a bottom spacer.

The second inclined member 17A is obliquely cut at a lower end part and includes a flat surface 17C at the sharp lower end part as shown in FIG. 7. Further, as shown in FIG. 3, an inclined opening surface of the second inclined member 17A is put on a side surface of the vertical member 14A and is thus closed, and the flat surface 17C at the lower end is put on and welded to the cover plate 14B as shown in FIG. 7. Further, as shown in FIG. 3, an upper end part of the second inclined member 17A is cut to be flush with an upper surface opening of the vertical member 14A, and a cover plate 17B is welded to the opening surface. Thus, an upper surface of the cover plate 17B on the upper end of the second inclined member 17A and an upper surface of the cover plate 14B on an upper end of the vertical member 14A are flush with each other.

As shown in FIG. 3, the first inclined member 30 configured of a channel member is welded between the upper end part of the vertical member 14A and the second inclined member 17A while being placed at such a position that an outer surface of a groove bottom wall 30B of the channel member is flush with outer surfaces of the cover plates 14B and 17B on the upper ends of the vertical member 14A and the second inclined member 17A. In addition, in the groove bottom wall 30B there are formed through holes 30C (see FIG. 4) at a plurality of positions in a longitudinal direction.

As shown in FIG. 3, the second truss 12 includes: a horizontal member 15A extending along the horizontal side 15 and configured of a square steel stock; a second inclined member 18A extending along the second inclined side 18 and configured of a square steel stock; and a first inclined member 31 extending along the first inclined side 16 and configured of a channel member. Further, similarly to the above vertical member 14A and the second inclined member 17A, the horizontal member 15A and the second inclined member 18A are welded to each other, and cover plates 15B and 18B are each welded to each of end parts of the horizontal member 15A and the second inclined member 18A. Similarly to the first inclined member 30 of the first truss 11, the first inclined member 31 of the second truss 12 is also welded between the horizontal member 15A and the second inclined member 18A while being placed at such a position that an outer surface of a groove bottom wall 31B of a channel member is flush with outer surfaces of the cover plates 15B and 18B of the horizontal member 15A and the second inclined member 18A. In addition, also in the groove bottom wall 31B there are formed through holes 31C (see FIG. 4) at a plurality of positions in a longitudinal direction.

Figure 4:
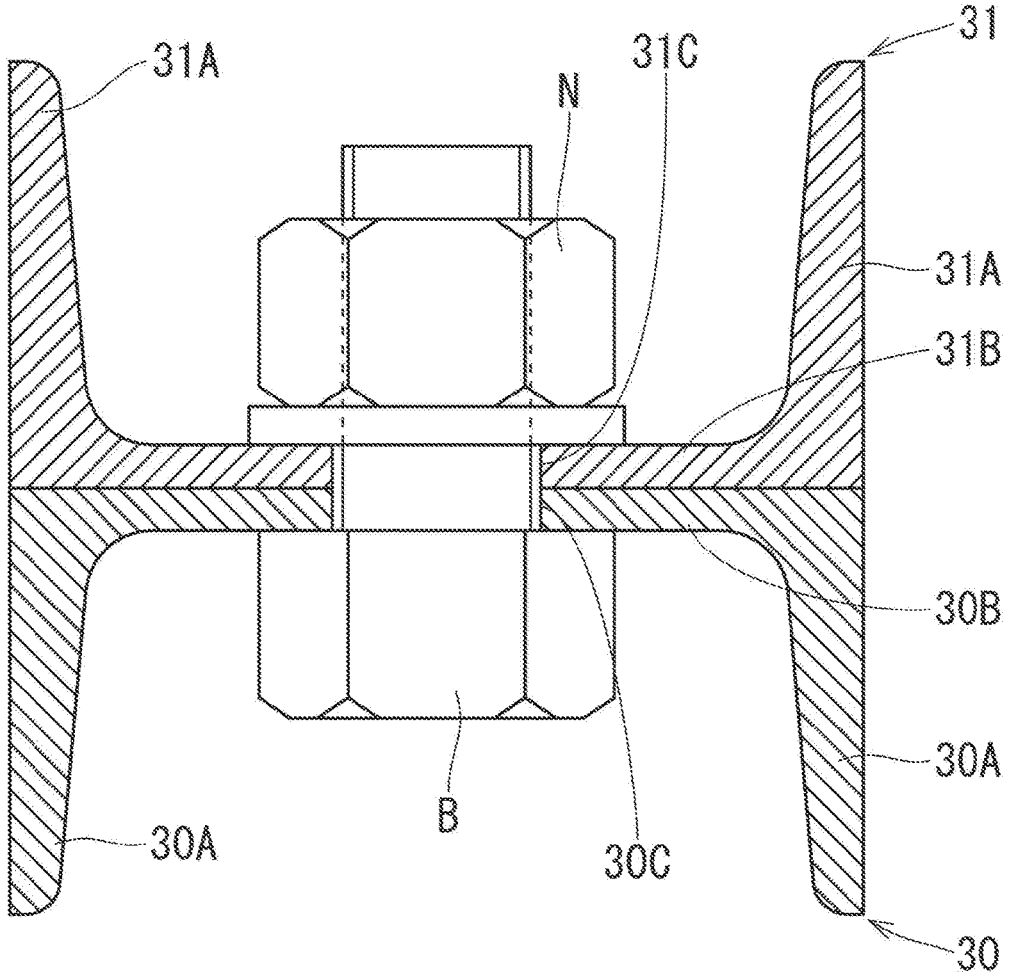
FIG. 4 is a cross-sectional view of first and second shared members on A-A cutting plane of FIG. 2.

Then, as shown in FIG. 4, the groove bottom walls 30B and 31B of the first inclined members 30 and 31 are stacked on each other, and nuts N are tightened on bolts B inserted through the through holes 30C and 31C, so that the first truss 11 and the second truss 12 are fixed to configure the compound truss 13 as shown in FIG. 1.

Figure 5A:
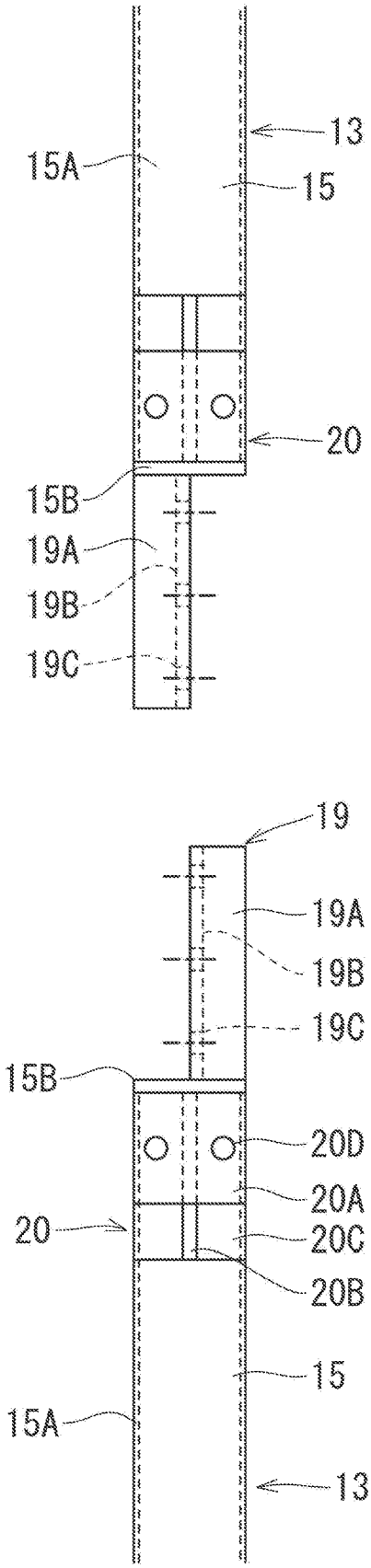
FIG. 5 is a plan view of a connection part between the compound trusses.
Figure 5B:
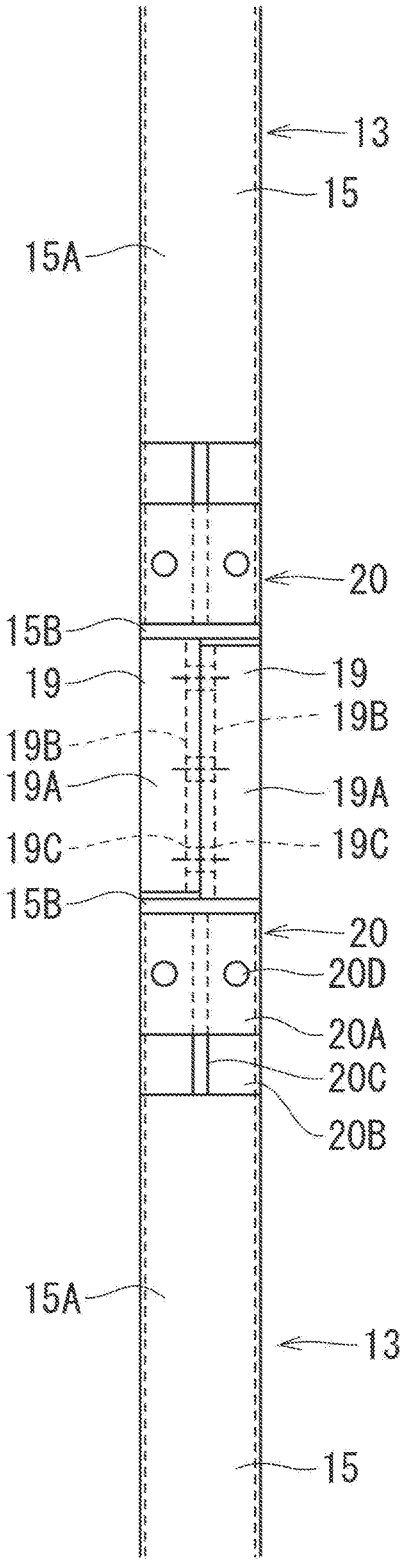

As shown in FIG. 3, from an outer surface of the cover plate 15B at a tip end of the horizontal member 15A of each compound truss 13 there is a coupling member 19 extending on an extension of the horizontal member 15A. The coupling member 19 has a square groove structure, and groove side walls 19A and 19A are placed on an upper and lower parts of a groove bottom wall 19B. Further, as shown in FIG. 5(A), the coupling member 19 is welded such that an outer surface of the groove bottom wall 19B is placed in an imaginary dividing surface that divides the cover plate 15B into two parts in the horizontal direction in FIG. 5(A). In addition, as shown in FIG. 3, in the groove bottom wall 19B there are formed a plurality of through holes 19C along a longitudinal direction of the groove bottom wall 19B. Then, as shown in FIG. 1, when the pair of compound trusses 13 and 13 are horizontally symmetrically placed and the tip ends of the horizontal sides 15 and 15 are butted to each other, the coupling members 19 and 19 of both of the compound trusses 13 and 13 overlap each other as shown in FIG. 5(B). In that state, nuts are fastened on bolts (not shown) inserted through the through holes 19C of the coupling members 19 and 19, so that the compound trusses 13 and 13 are fixed to be coupled to each other. In this case, the three through holes 19C of each of the coupling members 19 and 19 are overlapped each other; however, an interval between compound trusses 13 and 13 may be changed by overlapping only two through holes 19C of each of the coupling members 19 and 19 on each other or by overlapping only one through hole 19C on each other.

Note that, in the present embodiment, the coupling members 19 and 19 constitute a "central fixing part", and the horizontal members 15A and 15A coupled to each other with the coupling members 19 and 19 serve as a "beam extending horizontally in a straight line shape".

Figure 6:
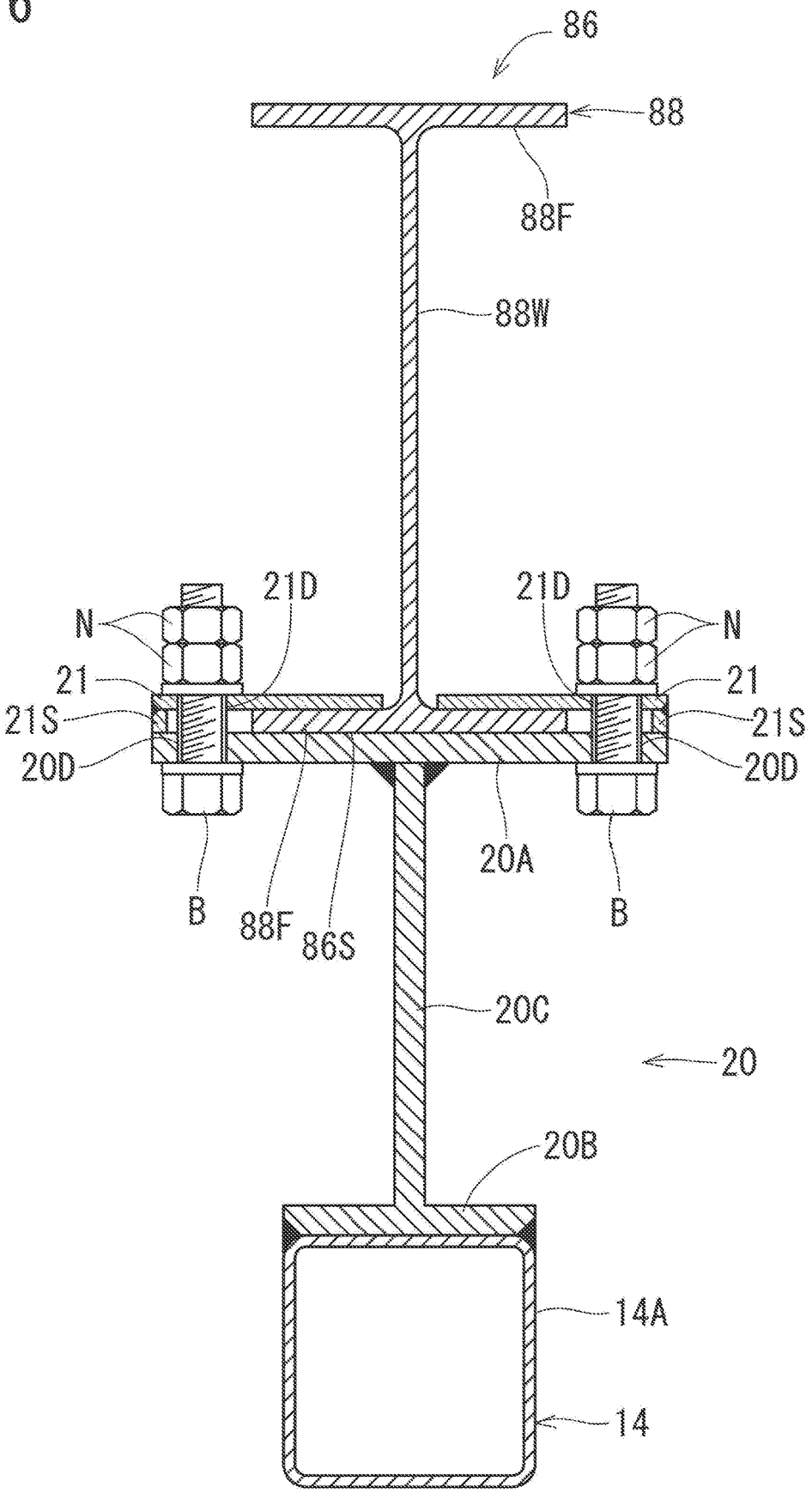
FIG. 6 is a cross-sectional view of a horizontal member and an upper part coupling member on B-B cutting plane of FIG. 2.

As shown in FIG. 3, each of upper surfaces of both end parts of the horizontal member 15A of each compound truss 13 includes an upper part coupling member 20. As shown in FIG. 6, the upper part coupling member 20 is constituted in such that an upper plate part 20A and a lower plate part 20B that are opposed to each other in a vertical direction are coupled to each other with a vertical plate part 20C. The lower plate part 20B has the same width as the horizontal member 15A and is welded while being overlapped on an upper surface of the horizontal member 15A. On the other hand, the upper plate part 20A has a wider width than the lower plate part 20B, is butted to a lower surface of a flange 88F of the beam 88 of the equipment frame 86 (in other words, a ceiling surface 86S of the equipment frame 86), and extends to both sides. In each of the parts of, the upper plate part 20A, extending from the flange 88F to the both sides there is formed a through hole 20D. Note that as shown in FIG. 3, in the longitudinal direction of the horizontal side 15, the upper plate part 20A is shorter than the lower plate part 20B, and the vertical plate part 20C is accordingly made in a trapezoidal shape.

As shown in FIG. 6, on the flange 88F of the beam 88 there are stacked a pair of clamping plates 21 and 21 each of which has a through hole 21D corresponding to the through hole 20D of the upper plate part 20A. Further, to an outer edge part of each clamping plate 21 there is welded a spacer member 21S having approximately the same thickness as the flange 88F. Then, nuts N are tightened on bolts B inserted through the through holes 20D and 21D of the upper plate part 20A and the clamping plates 21, so that the horizontal member 15A is fixed to the beam 88 via the upper part coupling member 20.

As shown in FIG. 7, to a lower end surface of the compound truss 13 there is fixed a bottom spacer 23. The bottom spacer 23 has a housing structure, and a side surface shape of the bottom spacer 23 is a trapezoid. Further, the bottom spacer 23 is fixed to the lower end surface of the compound truss 13 with metal bonding adhesive in a state where an inclined surface of the bottom spacer 23 and an inclined outer surface of the second inclined member 17A are made flush with each other. Further, the bottom spacer 23 is placed on the floor surface 80F via the horizontal wall 89B of the above angle member 89.

Between each inner side surface 86N of the equipment frame 86 and the lower end part of the vertical member 14A there is formed a slight gap G. Further, a wedge member 24 is pressed into the gap G, and the lower end part of the compound truss 13 is fixed to the equipment frame 86 by frictional engagement between the wedge member 24 and each of the compound truss 13 and the equipment frame 86.

The configurations of the reinforcement structure 10, the equipment frame 86, and the booth 80 of the present embodiment have been described above. Next, an operation and effect of the above reinforcement structure 10 and the like will be described. In order to install the reinforcement structures 10 of the present embodiment in, for example, an existing booth 80, a plurality of pairs of first trusses 11 and second trusses 12 for a necessary number of reinforcement structures 10 are separately manufactured in advance at a place such as a factory different from an installation place of the reinforcement structures 10. At that time, for example, the coupling member 19 and the upper part coupling member 20 are fixed to each second truss 12, and the first trusses 11 and the bottom spacers 23 are separated; and a plurality of kinds of bottom spacers 23 having different heights are prepared.

At the installation site of the reinforcement structures 10, the first trusses 11 and the second trusses 12 are fixed to each other by bolt fixation between the above-mentioned first inclined members 30 and 31 (see FIG. 4), so that the pair of compound trusses 13 and 13 is completed. Next, the coupling members 19 and 19 of the pair of compound trusses 13 and 13 are fixed with bolts (see FIG. 5(B)) and are placed inside the equipment frame 86. Then, each upper part coupling member 20 is fixed with bolts to the flange 88F of the beam 88 of the equipment frame 86 (see FIG. 6).

The assembly work of the reinforcement structure 10 up to this point may also be performed in the following procedure. Specifically, a pair of the second trusses 12 and 12 before the first trusses 11 are fixed are temporarily fixed to the beam 88 of the equipment frame 86 with the upper part coupling members 20. Next, the second trusses 12 and 12 are slid along the beam 88 to align, and the coupling members 19 and 19 of both of the second trusses 12 and 12 are fixed with bolts to each other, and that each upper part coupling member 20 is fully fixed to the beam 88. Then, the first trusses 11 are each fixed to the corresponding second truss 12. By this assembly procedure, in a case where the line equipment 85 is previously installed in the booth 80, the reinforcement structure 10 can be smoothly assembled.

When the work of any of the above-mentioned procedures is finished, the reinforcement structure 10 is hanging from the beam 88 of the equipment frame 86 and is not in contact with the floor surface 80F. Therefore, the bottom spacer 23 is chosen that has a height a bit greater than a space from the lower end surface of each compound truss 13 to the floor surface 80F (or to the horizontal wall 89B or the like if the horizontal wall 89B of the angle member 89 or the like is laid on the floor surface 80F), and the upper surface of bottom spacer 23 is treated with a metal bonding adhesive and is pressed into between the vertical side 14 and the floor surface 80F. In addition, the wedge member 24 is pressed into the gap G between the lower end part of the compound truss 13 and the inner side surface 86N of the equipment frame 86. With these arrangements, the lower end parts of the vertical sides 14 and 14 of the reinforcement structure 10 are fixed to the lower end parts of the equipment frame 86 and to the floor surface 80F by frictional engagement, and the assembly of the reinforcement structure 10 to the equipment frame 86 is thus completed.

When the reinforcement structure 10 is assembled to the equipment frame 86 as described above, vertical sides 14 of the compound trusses 13 and the horizontal side 15 are respectively kept along the inner side surfaces 86N and 86N of the equipment frame 86 and along the ceiling surface 86S of the equipment frame 86. This controls variations in angles between the ceiling surface 86S of the equipment frame 86 and each of the inner side surfaces 86N and 86N. Specifically, strength of the equipment frame 86 against a lateral-shaking earthquake is increased. Here, the first truss 11 and the second truss 12 of each of the compound trusses 13 and 13 share the first inclined side 16 extending obliquely downward from the upper end of the vertical side 14. Further, a pair of bent sides 50 and 50, each of which is constituted by the second inclined side 17 and 18 of the first truss 11 and the second truss 12, are structured to be bent toward the side away from the symmetry center of the pair of compound trusses 13 and 13. This arrangement can secure a large space between the pair of compound trusses 13 and 13. That is, the reinforcement structure 10 of the present embodiment can reinforce the equipment frame 86 without causing any obstacle inside the equipment frame 86 like braces. As a result, earthquake-resistance strength of the equipment frame 86 and the booth 80 can be higher than before, and at the same time, a large internal space is secured.

Further, the "reinforcement structure" may be configured such that, for example, a part of the equipment frame 86 constitutes the vertical side and the horizontal side, which are parts of the reinforcement structure. However, in the reinforcement structure 10 of the present embodiment, members separate from the equipment frame 86 constitute all of the reinforcement structure 10, so that the installation work of the reinforcement structure 10 in a previously installed equipment frame 86 can be performed easily. In addition, the horizontal members 15A and 15A of the pair of compound trusses 13 and 13 are separately provided, and the horizontal members 15A and 15A are structured to be fixed to each other; therefore, the reinforcement structure 10 can be disassembled into the pair of compound trusses 13 and 13 to be transported to an installation site. Further, each compound truss 13 can be transported to an installation site in a state of being disassembled into the first truss 11 and the second truss 12, and the transportation work can therefore be performed easily.

Further, the pair of first inclined members 30 and 31, which are stacked and fixed between the first truss 11 and the second truss 12, are configured of channel members, and the opposing walls 30A, 31A of the channel members therefore serve as a rib, so that strength of the part shared by the first truss 11 and the second truss 12 can be increased. In addition, the horizontal members 15A and 15A of the pair of compound trusses 13 and 13 are coupled to each other and function as a "straight line member" extending in a straight line shape; therefore, a horizontal load due to a lateral-shaking earthquake is efficiently transferred between the pair of compound trusses 13 and 13 through the straight line member, so that the load to the equipment frame 86 can be reduced.

Second Embodiment

Figure 8:
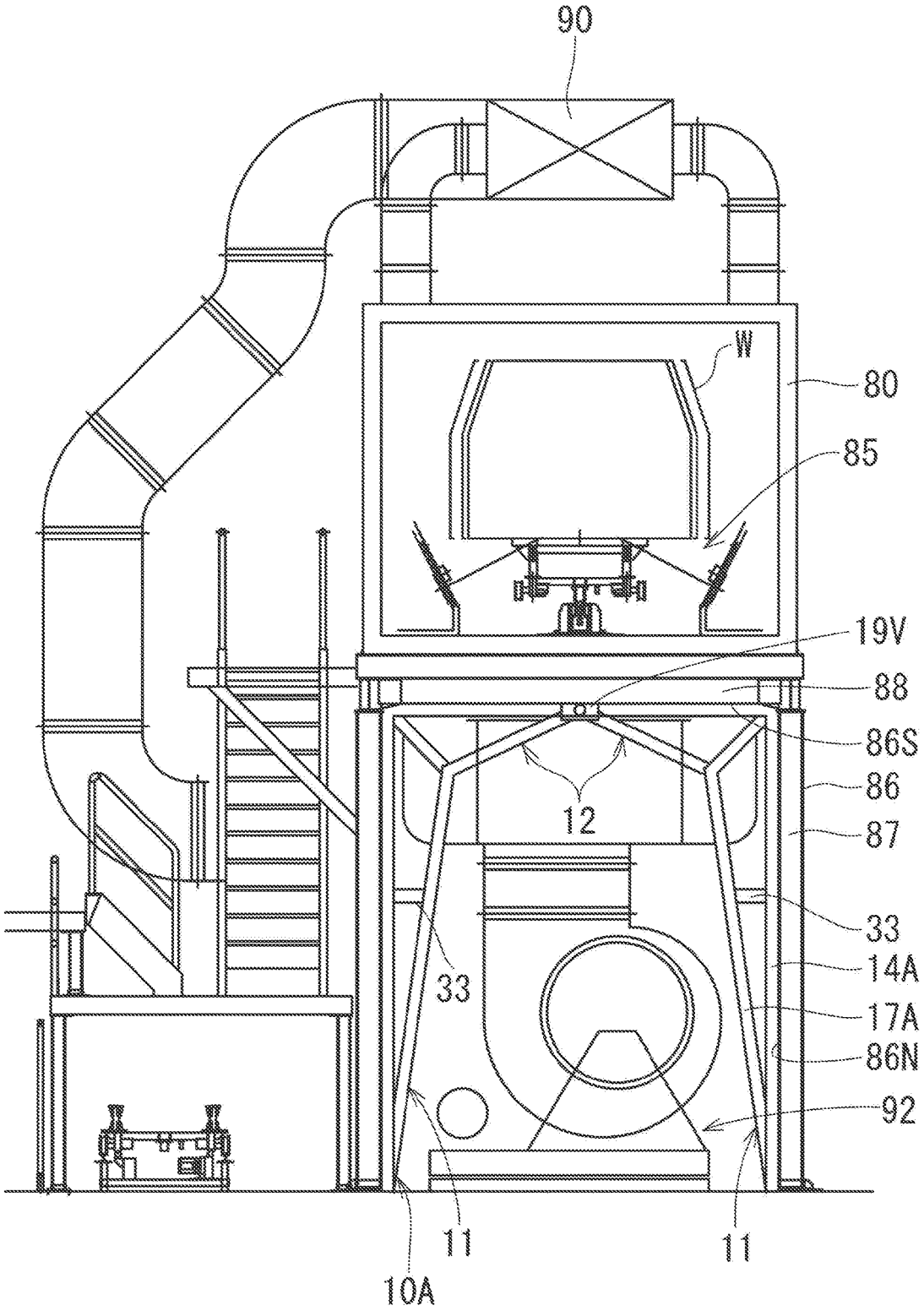
FIG. 8 is a front view of a reinforcement structure and a construction of a second embodiment.

A reinforcement structure 10A of the present embodiment shown in FIG. 8 is assembled inside an equipment frame 86 that supports a booth 80 from below. The reinforcement structure 10A is different from the reinforcement structure 10 of the first embodiment in that a pair of compound trusses 13 and 13 are rotatably coupled by a central hinge part 19V. Further, regarding the reinforcement structure 10A, the height is greater than the width, and reinforcement bars 33 each connecting between a vertical member 14A and a second inclined member 17A are provided at an intermediate position in the height direction. Note that in a space formed below the booth 80 by the equipment frame 86 there is placed air-conditioning equipment 92 that suctions air in the booth 80.

The reinforcement structure 10A of the present embodiment also provides a similar operation and effect to the first embodiment. Further, in the reinforcement structure 10A, a horizontal load due to a lateral-shaking earthquake is transferred between the pair of compound trusses 13 and 13 through the central hinge part 19V, and the load to the equipment frame 86 can be reduced.

Third Embodiment

Figure 9:
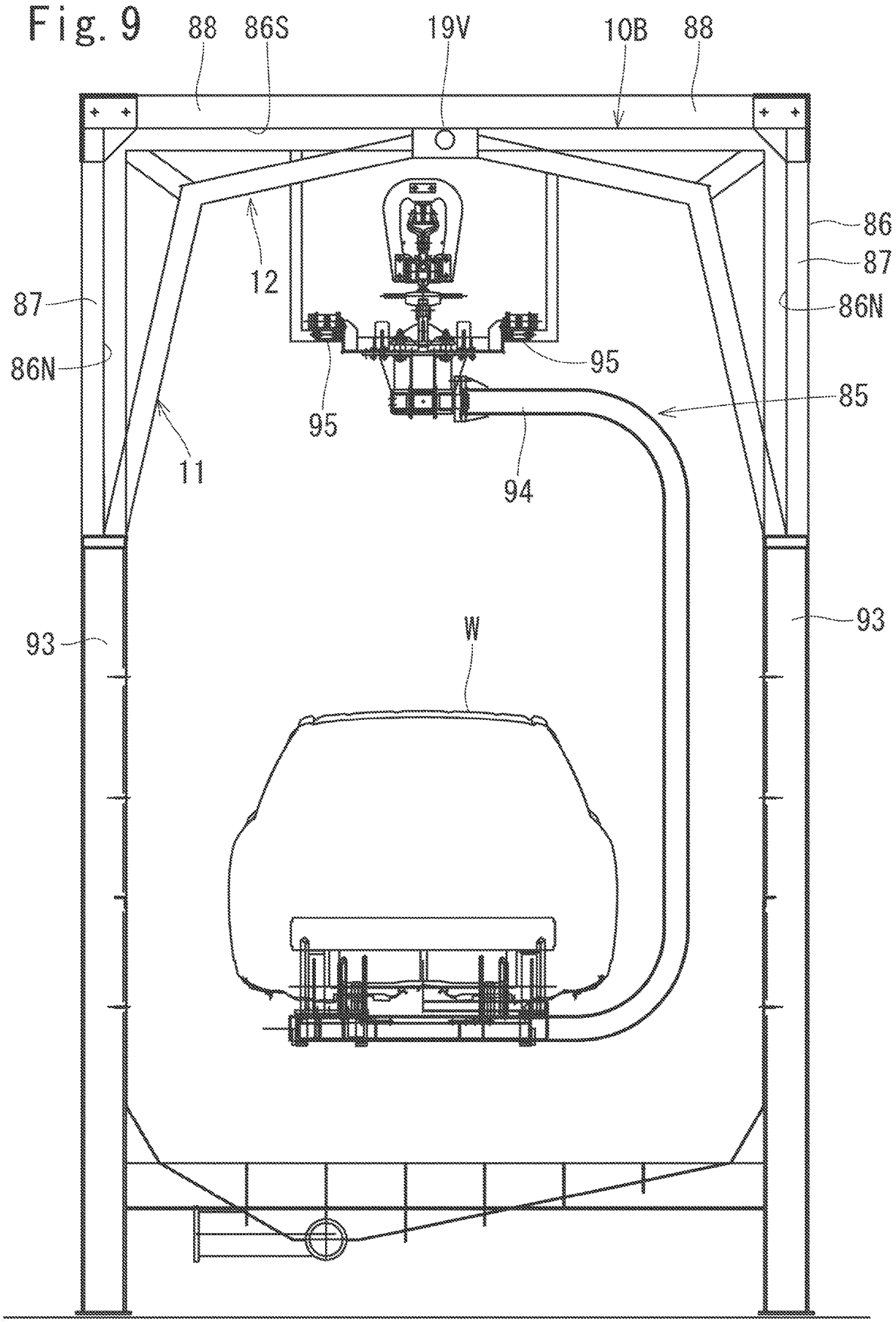
FIG. 9 is a front view of a reinforcement structure and a construction of a third embodiment.

Line equipment 85 shown in FIG. 9 includes a lift 94 that conveys a work W while suspending the work W. The lift 94 moves on a pair of rails 95 and 95 suspended from the beam 88 of the equipment frame 86. The equipment frame 86 stands up on a pair of opposing support walls 93, 93. Further, the reinforcement structure 10B of the present embodiment is fit inside the equipment frame 86 and is fixed to upper surfaces of the opposing support walls 93. By using the reinforcement structure 10B for such equipment, lateral-shaking is prevented, so that the work W can be conveyed stably.

Fourth Embodiment

Figure 10:
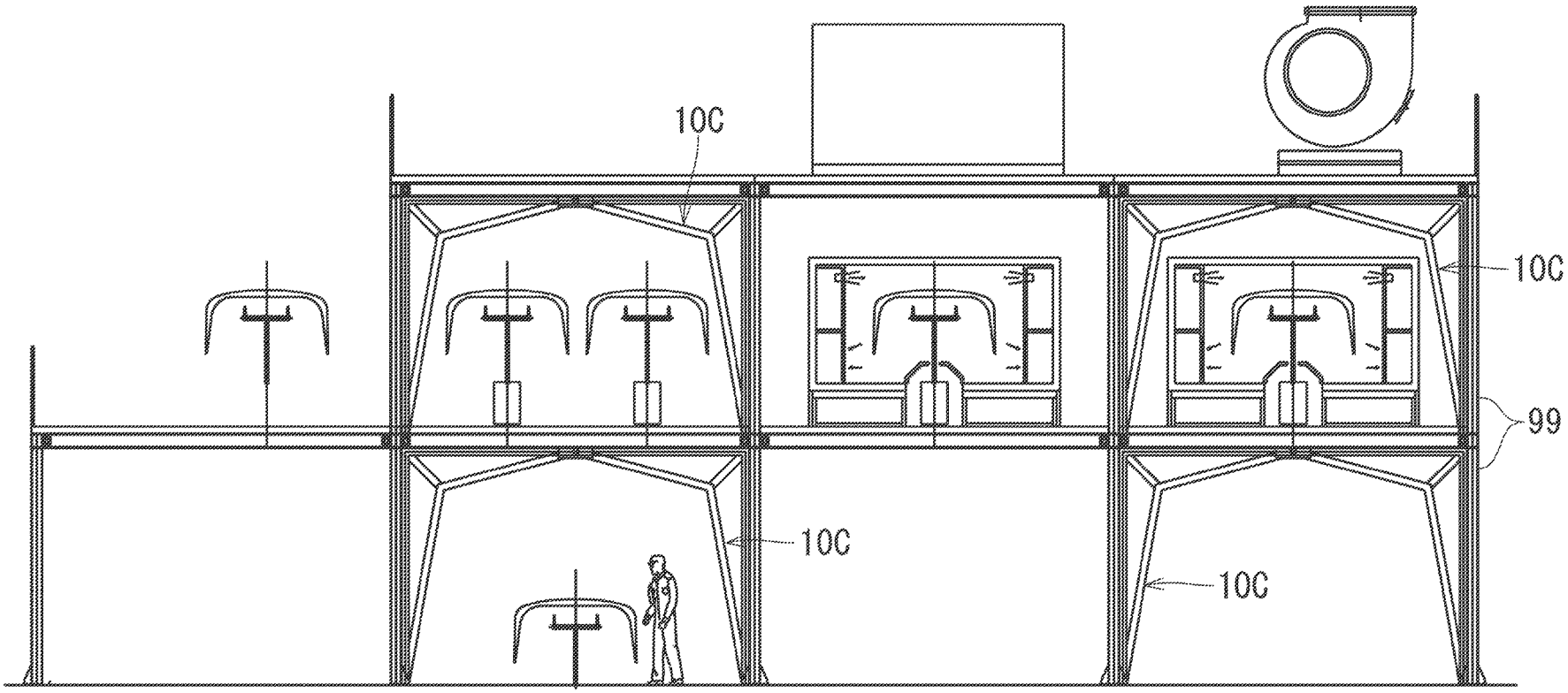
FIG. 10 is a front view of a reinforcement structure and a construction of a fourth embodiment.

Reinforcement structures 10B of the present embodiment are shown in FIG. 10 and are assembled inside storage rooms 99 that can be extended by being coupled to each other in a matrix. The use of the reinforcement structures 10B in combination with such storage rooms 99 provides an effect that the number of storage room 99 to be stackable can be increased.

Fifth Embodiment

Figure 11:
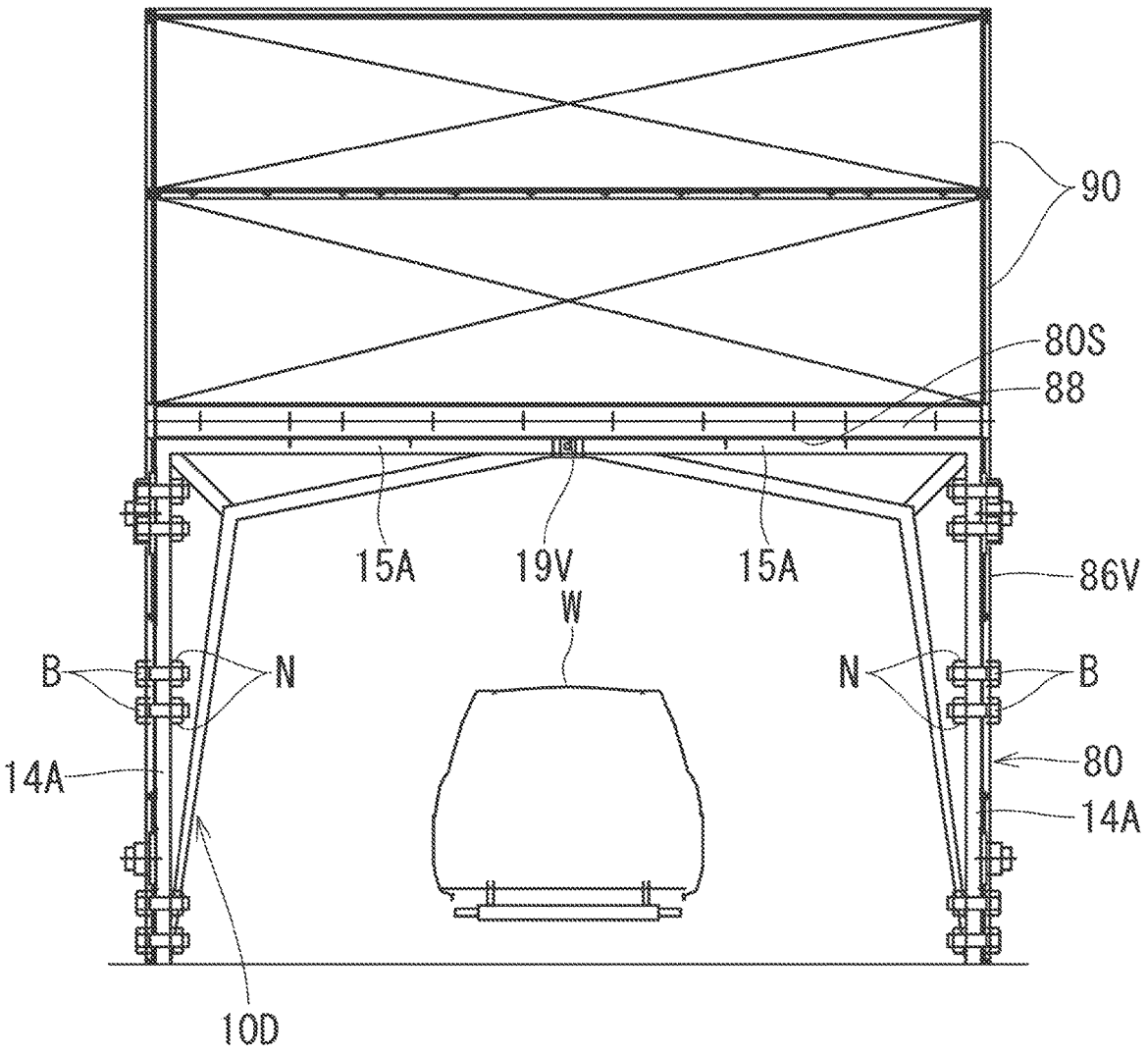
FIG. 11 is a front view of a reinforcement structure and a construction of a fifth embodiment.

A reinforcement structure 10C of the present embodiment is shown in FIG. 11, and a pair of vertical members 14A and 14A are fixed to both of side walls 86V and 86V at a plurality of positions of a booth 80 with bolts B and nuts N. Further, neither of horizontal members 15A and 15A has a fixing member with which the horizontal member 15A is fixed to a ceiling surface 80S of the booth 80, and the horizontal members 15A and 15A are only overlapped on the ceiling surface 80S of the booth 80. Also when the reinforcement structure 10C is attached to the booth 80 in the above manner, earthquake-resistance strength of the booth 80 against lateral-shaking is increased.

Other Embodiments (1) In the above reinforcement structure 10 of the first embodiment, a plurality of kinds of first trusses 11 and second trusses 12 whose sides except the first inclined side 16 have different lengths may be prepared, and the first trusses 11 and the second trusses 12 may be arbitrarily combined and used.

(2) In the above embodiments, a fixing method between members may be arbitrarily changed to bolt, rivet, welding, adhesive, or the like.

Figure 12:
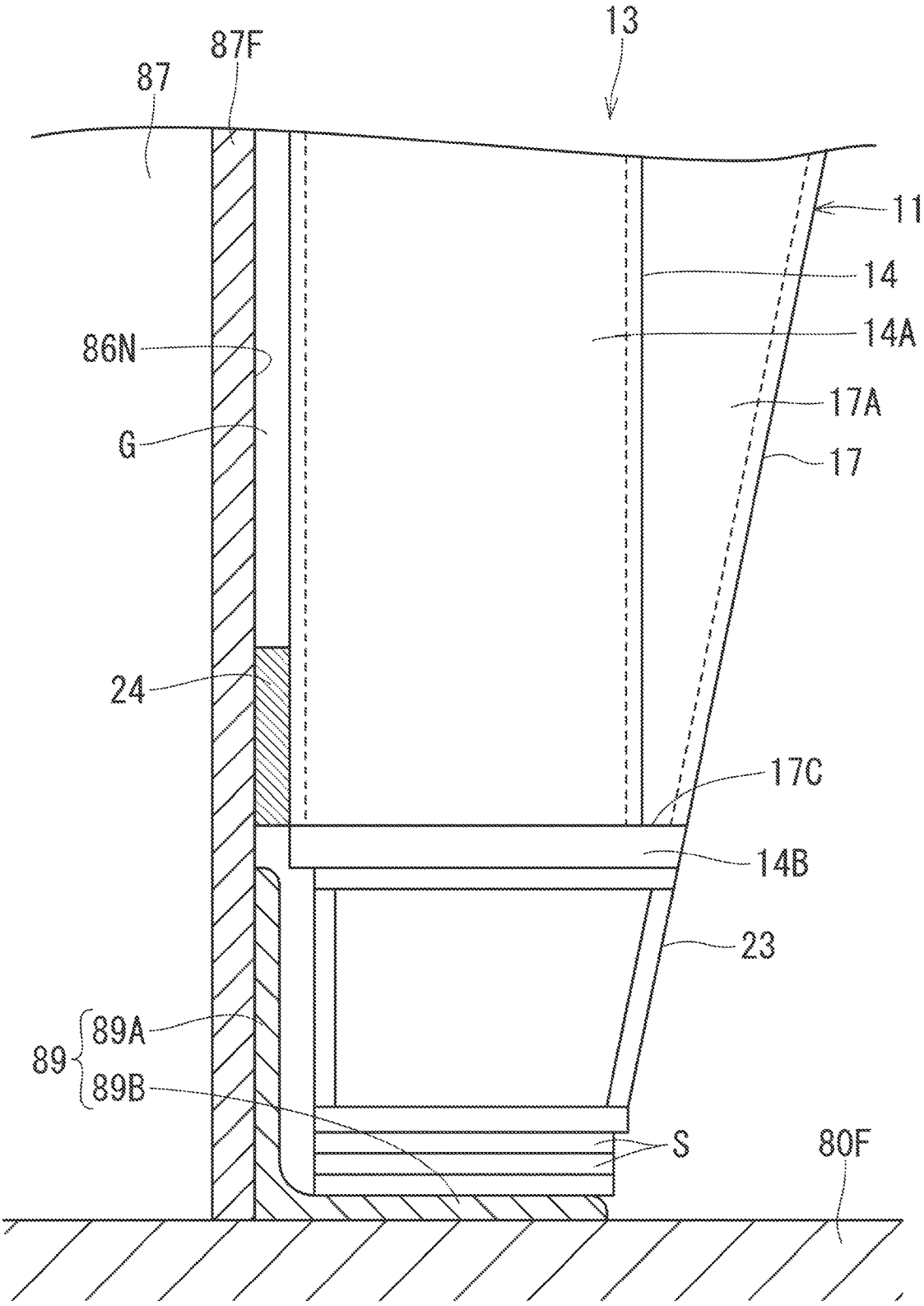
FIG. 12 is a side view of a lower end part of a compound truss and a bottom spacer according to a modified example.

(3) In the above first embodiment, the height of the bottom spacer 23 is changed to adjust the height of the compound truss 13; however, as shown in FIG. 12, the following measures may be taken. The bottom spacer 23 is made to have a constant height, and a shim or shims S are inserted between the bottom spacer 23 and the floor surface 80F to adjust the height by changing the thickness or number of the shims. Alternatively, the wedge member 24, which is pressed into between the compound truss 13 and the inner side surface 86N of the equipment frame 86, may be pressed into between the bottom spacer 23 and the floor surface 80F to eliminate a gap between the compound truss 13 and the floor surface 80F.

(4) In the above first embodiment, the coupling members 19 and 19 are stacked in a horizontal direction, but the coupling members 19 and 19 may be configured to be stacked in a vertical direction. However, when the coupling members 19 and 19 are configured to be stacked in a horizontal direction as in the above embodiment, the pair of compound trusses 13 and 13 can be made in the same shape, and the work of fixing the coupling members 19 and 19 to each other can be easy.

(5) In the above embodiments, the compound trusses 13 and 13 are coupled to each other; however, the following configuration may be used. The compound trusses 13 and 13 are not coupled to each other but are coupled to the ceiling surfaces 80S or 86S of the construction, and the compound trusses 13 and 13 are coupled to each other via the construction.

(6) In the above embodiments, the vertical member 14A of compound truss 13 is overlapped on the inner side surface 86N or 86V of the construction, but the following measures may be taken to reinforce the construction, for example. The vertical member 14A of the compound truss 13 is placed at a position inwardly shifted from the inner side surface 86N or 86V of the construction and is fixed to the floor surface 80F, and the horizontal member 15A is fixed to the ceiling surface 80S or 86S of the construction.

(7) In the above embodiments, the first inclined members 30 and 31 are configured of channel members; however, the first inclined members 30 and 31 may be configured of angle members.

(8) In the above embodiments, the horizontal members 15A and 15A of the pair of compound trusses 13 and 13 are configured of individual members; however, the horizontal members 15A and 15A may be configured of a single member.

DESCRIPTION OF THE REFERENCE NUMERAL

10, 10A to 10D Reinforcement structure
11 First truss
12 Second truss
13 Compound truss
14 Vertical side
14A Vertical member
15 Horizontal side
15A Horizontal member
16 First inclined side
17, 18 Second inclined side
17A, 18A Second inclined member
19 Coupling member
19V Central hinge part
20 Upper part coupling member
20A Upper plate part
20B Lower plate part
20C Vertical plate part
23 Bottom spacer
24 Wedge member
30, 31 First inclined member
50 Bent side
80 Booth
80S Ceiling surface
85 Line equipment
86 Equipment frame
80F Floor surface
86N Inner side surface
86S Ceiling surface
87 Column
88 Beam

The invention claimed is:

1. A reinforcement structure that reinforces a construction from inside, the reinforcement structure comprising:
- a first truss including:
  - a vertical side extending vertically;
  - a first inclined side extending obliquely downward from an upper end of the vertical side; and
  - a second inclined side connecting a lower end of the vertical side and a lower end of the first inclined side;
- a second truss sharing the first inclined side with the first truss and including:
  - a horizontal side extending horizontally from the upper end of the vertical side of the first truss; and
  - a second inclined side connecting between a tip end of the horizontal side and the lower end of the first inclined side;
- a pair of compound trusses each of which is constituted by the first truss and the second truss and which are horizontally symmetrically placed, wherein the pair of compound trusses are coupled to the construction in a state where, in each of the compound trusses, the vertical side is along an inner side surface of the construction, and the horizontal side is along a ceiling surface of the construction; and
- a pair of bent sides each of which is provided in each of the pair of compound trusses and is constituted by the second inclined side of the first truss and the second inclined side of the second truss, wherein each of the bent sides has a shape of being bent toward a side away from a symmetry center of the pair of compound trusses,
- wherein both of the horizontal sides of the pair of compound trusses are each separately configured of a long member, and
- wherein the reinforcement structure comprises a central hinge part that rotatably couples the long members to each other.

2. A reinforcement structure that reinforces a construction from inside, the reinforcement structure comprising:
- a first truss including:
  - a vertical side extending vertically;
  - a first inclined side extending obliquely downward from an upper end of the vertical side; and
  - a second inclined side connecting a lower end of the vertical side and a lower end of the first inclined side;
- a second truss sharing the first inclined side with the first truss and including:
  - a horizontal side extending horizontally from the upper end of the vertical side of the first truss; and
  - a second inclined side connecting between a tip end of the horizontal side and the lower end of the first inclined side;

a pair of compound trusses each of which is constituted by the first truss and the second truss and which are horizontally symmetrically placed, wherein the pair of compound trusses are coupled to the construction in a state where, in each of the compound trusses, the vertical side is along an inner side surface of the construction, and the horizontal side is along a ceiling surface of the construction; and a pair of bent sides each of which is provided in each of the pair of compound trusses and is constituted by the second inclined side of the first truss and the second inclined side of the second truss, wherein each of the bent sides has a shape of being bent toward a side away from a symmetry center of the pair of compound trusses, wherein:

the first inclined side is configured of two long members vertically stacked on each other, the long member on a lower side of the first inclined side is connected to both of long members each constituting the vertical side and the second inclined side of the first truss, and the long member on an upper side of the first inclined side is connected to both of long members each constituting the horizontal side and the second inclined side of the second truss.

3. The reinforcement structure according to claim 2, wherein the two long members constituting the first inclined side are channel members or angle members that are stacked and fixed to each other back on back.

4. A reinforcement structure that reinforces a construction from inside, the reinforcement structure comprising:

a first truss including:

a vertical side extending vertically;

a first inclined side extending obliquely downward from an upper end of the vertical side; and a second inclined side connecting a lower end of the vertical side and a lower end of the first inclined side;

a second truss sharing the first inclined side with the first truss and including:

a horizontal side extending horizontally from the upper end of the vertical side of the first truss; and a second inclined side connecting between a tip end of the horizontal side and the lower end of the first inclined side;

a pair of compound trusses each of which is constituted by the first truss and the second truss and which are horizontally symmetrically placed, wherein the pair of compound trusses are coupled to the construction in a state where, in each of the compound trusses, the vertical side is along an inner side surface of the construction, and the horizontal side is along a ceiling surface of the construction;

a pair of bent sides each of which is provided in each of the pair of compound trusses and is constituted by the second inclined side of the first truss and the second inclined side of the second truss, wherein each of the bent sides has a shape of being bent toward a side away from a symmetry center of the pair of compound trusses; and an upper part coupling member including:

a lower plate part that is overlapped on and fixed to an upper surface of the long member constituting the horizontal side;

an upper plate part that is fixed to a ceiling surface of the construction; and a vertical plate part that connects the lower plate part and the upper plate.

5. The reinforcement structure according to claim 1, comprising a bottom spacer fixed to a lower end surface of each of the compound trusses.

6. The reinforcement structure according to claim 2, comprising a bottom spacer fixed to a lower end surface of each of the compound trusses.

7. The reinforcement structure according to claim 4, comprising a bottom spacer fixed to a lower end surface of each of the compound trusses.

8. The reinforcement structure according to claim 5, comprising a shim that is held between the lower end surface of each of the compound trusses and a floor surface to adjust a height.

9. The reinforcement structure according to claim 6, comprising a shim that is held between the lower end surface of each of the compound trusses and a floor surface to adjust a height.

10. The reinforcement structure according to claim 7, comprising a shim that is held between the lower end surface of each of the compound trusses and a floor surface to adjust a height.

11. The reinforcement structure according to claim 1, comprising a wedge member that is pressed into between a long member constituting the vertical side and an inner side surface of the construction or a floor surface to fix the long member constituting the vertical side to the inner side surface of the construction or the floor surface by frictional engagement.

12. The reinforcement structure according to claim 2, comprising a wedge member that is pressed into between a long member constituting the vertical side and an inner side surface of the construction or a floor surface to fix the long member constituting the vertical side to the inner side surface of the construction or the floor surface by frictional engagement.

13. The reinforcement structure according to claim 4, comprising a wedge member that is pressed into between a long member constituting the vertical side and an inner side surface of the construction or a floor surface to fix the long member constituting the vertical side to the inner side surface of the construction or the floor surface by frictional engagement.

14. An equipment frame that has a structure, supports equipment of a factory, and is the construction, the equipment frame comprising:

the reinforcement structure according to claim 1 inside the equipment frame.

15. An equipment frame that has a structure, supports equipment of a factory, and is the construction, the equipment frame comprising:

the reinforcement structure according to claim 2 inside the equipment frame.

16. An equipment frame that has a structure, supports equipment of a factory, and is the construction, the equipment frame comprising:

the reinforcement structure according to claim 4 inside the equipment frame.

17. A booth that covers line equipment and is the construction, the booth comprising:

a plurality of the reinforcement structures according to claim 1 in a state where the reinforcement structures bridge over the line equipment.

18. A booth that covers line equipment and is the construction, the booth comprising:

a plurality of the reinforcement structures according to claim 2 in a state where the reinforcement structures bridge over the line equipment.

19. A booth that covers line equipment and is the construction, the booth comprising:

a plurality of the reinforcement structures according to claim 4 in a state where the reinforcement structures bridge over the line equipment.

* * * * *